United States Patent [19]
Ciccarello

[11] 4,235,441
[45] Nov. 25, 1980

[54] DIFFRACTIONATED GOLF BALL

[76] Inventor: Richard Ciccarello, 7 Park Ave., Glen Cove, N.Y. 11542

[21] Appl. No.: 75,658

[22] Filed: Sep. 14, 1979

Related U.S. Application Data

[63] Continuation-in-part of Ser. No. 937,474, Aug. 28, 1978, abandoned.

[51] Int. Cl.[3] ..... A63B 43/00; A63B 69/36
[52] U.S. Cl. ..... 273/213; 273/232; 273/183 C; 40/327
[58] Field of Search ..... 273/213, 183 C, 183 E, 273/232, DIG. 24, 235 R, 235 A, 235 B, 233, 234, 35 A, 183 A, 186 C; 40/330, 331, 327

[56] References Cited

U.S. PATENT DOCUMENTS

| | | | |
|---|---|---|---|
| 1,795,732 | 3/1931 | Miller | 273/213 |
| 2,709,595 | 5/1955 | DeVries | 273/183 C |
| 2,861,810 | 11/1958 | Veatch | 273/213 |
| 2,929,631 | 3/1960 | Gillon | 273/183 E |
| 3,630,601 | 12/1971 | Lehovec | 273/183 C |
| 3,753,565 | 8/1973 | Baker | 273/213 |
| 3,759,528 | 9/1973 | Christophers et al. | 273/213 X |

FOREIGN PATENT DOCUMENTS

| | | | |
|---|---|---|---|
| 20780 | of 1929 | Australia | 273/232 |

OTHER PUBLICATIONS

Edmund Scientific Co., Catalog 731, 1972, p. 159.

*Primary Examiner*—George J. Marlo

[57] ABSTRACT

This invention relates to a golf ball adapted to improve a golfer's score in that the dimples, or cavities, which are aligned on the great circle of the golf ball are provided with diffraction discs whereby the golfer is instantly warned of movement of his eyes and head when looking at the ball while addressing same and executing a golf club swing.

In the game of golf, it is most important for the golfer to rivet his eyes to the ball prior to and during the swing of the golf club. Even the slightest movement of this riveted or fixed gaze upon the ball during the swinging of the club can give unwanted and even disasterous results.

It is an objective of this invention to provide a new and novel golf ball capable of improving a golfer's game.

It is another objective to provide a novel golf ball article of manufacture having diffraction means thereon which indicates, by color change, even the slightest movement of the eyes and head fixed to said ball.

The prior art in the field of novel golf balls is quite extensive and includes Australian Patent 20,780/29 and U.S. Patents 2,861,810 (Veatch); 3,753,565 (Baker); 2,929,631 (Gillon) and 1,795,732 (Miller).

2 Claims, 4 Drawing Figures

DIFFRACTIONATED GOLF BALL

This application is a continuation-in-part of Pat. application Ser. No. 937,474 filed Aug. 28, 1978, now abandoned.

This invention permits the golfer to align his eyes to the ball to be struck, and thereafter maintain this alignment during the swing of the golf club, thereby permitting the golfer to bring about a perfect or almost perfect hitting of the ball.

To this end, the dots of the great circle of dots of the golf ball are each provided with a suitable diffraction disc. The conventional golf ball has but one great circle of dots, the other dots of cavitations are disposed to the right or to the left of this great circle. A great circle by mathematical definition has a plane passing through the center of the sphere thereby dividing it into two (2) hemispheres. Only one great circle of dots is present on the conventional golf ball to permit a linear-like alignment of the dots on the curved surface of the sphere.

In this invention, a minimum of three (3) contiguous dots having diffraction discs therein are operable. Preferably, all the dots or cavities of the great circle of dots are each provided with a suitable diffraction grating disc secured to the golf ball's surface by pressure-sensitive adhesive disposed on the back or golf contacting surface of the disc. Since the cavities or dots of a golf ball are about one-eighth (⅛") inch in diameter, the respective discs are also one-eighth (⅛") inch in diameter, thereby completely filling the dot.

This invention is described herein by means of an illustrative embodiment shown in the accompanying drawing in which.

Figure 1:
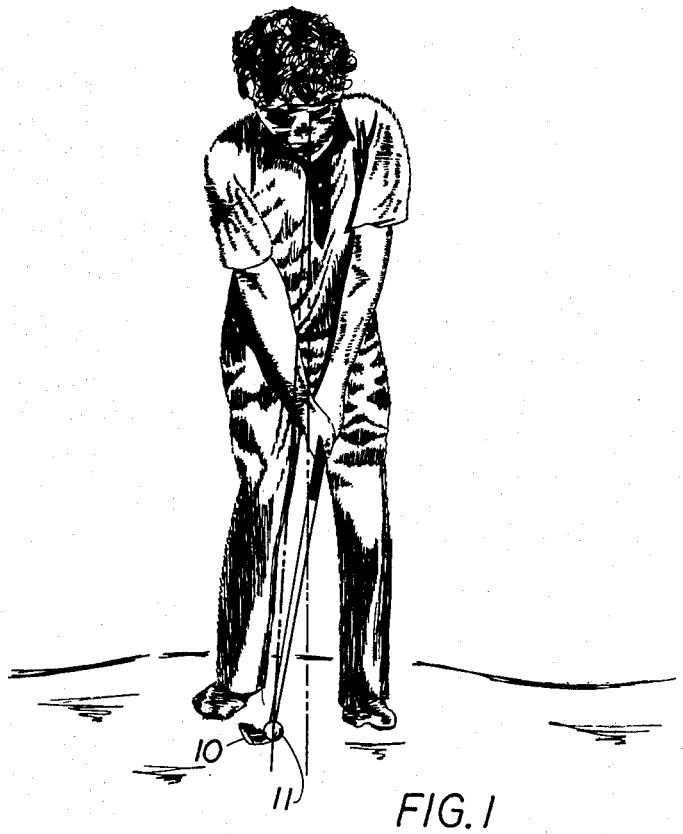
FIG. 1, is a view of a golf player addressing or engaging the golf ball with a golf club in the preferred professional manner.
Figure 2:
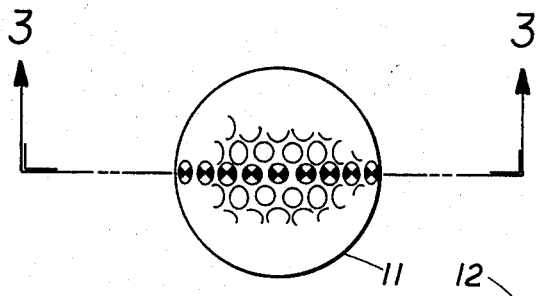
FIG. 2, is a top view of the golf ball showing diffraction discs disposed contiguously in the dots of the great circle.

Turning to the drawing, there is shown a golfer having its eyes fixed to the golf ball so that they and the golfer's head are stationary during the golfer's swing and follow-through of the golf club.

As shown in FIG. 1, the golf club 10 contacts the golf ball 11 while the golfer fixes his eyes on the diffraction discs of dots curvilinearly disposed in the great circle of dots of the golf ball. This fixed gaze on the diffraction discs produces a specific and distinct color pattern. The slightest movement of the head and eyes as a unit, produces a different color pattern, thereby informing the golfer he has broken the fixed steady gaze and that the resulting swing of the golf club will be less than perfect.

When a golf ball is to be hit, the great circle of diffraction dots is aligned at substantially a right angle to the golfer. In this position, only the top most three (3) or four (4) diffraction dots are effectively viewed by the eyes of the golfer.

Clearly, a golf ball having but three (3) or so contiguous great circle dots provided with diffraction dots is operable in this invention.

Figure 3:
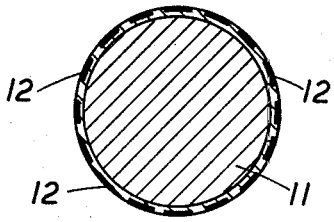
FIG. 3, is a section view taken on line 3—3 of FIG. 2 showing sixteen (16) diffraction discs disposed in the sixteen (16) dots of the great circle of dots of a conventional golf ball.
Figure 4:
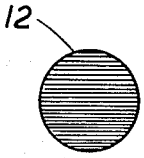
FIG. 4, is a top view of a diffraction grating having close parallel grooves adapted to break up light beams into his spectrum of color components.

As shown in FIG. 3, the diffraction discs 12 having a top surface having a diffraction grating and a bottom surface having conventional pressure-sensitive adhesive is secured within each of the great circle dots.

The golf balls of this invention preferably have all the dots in the great circle provided with a diffraction disc. However, since the gaze of the golfer's eyes can view only the topmost three (3) or so curvilinearly disposed dots and discs, a great circle provided with only a half-circle or even a quarter-circle of dots is operable and included in the articles of manufacture herein. It is also possible to skip a dot so that alternate dots are provided with diffraction discs albeit this is not a preferred form of the novel golf ball.

I claim:

1. As an article of manufacture, a golf ball, wherein the great circle of cavities therein is provided with at least three (3) contiguous diffraction discs, to form a curvilinear alignment of discs to the eye of the golfer.

2. The golf ball of claim 1 wherein all the cavities of the great circle of cavities are each provided with a diffraction disc.

* * * * *